US012139978B2

(12) United States Patent
Hartung et al.

(10) Patent No.: US 12,139,978 B2
(45) Date of Patent: Nov. 12, 2024

(54) HIGH PRESSURE INJECTION FLUSHING HEADS AND SYSTEMS INCLUDING SUCH FLUSHING HEADS

(71) Applicant: BOART LONGYEAR COMPANY, Salt Lake City, UT (US)

(72) Inventors: Markus Hartung, Hünfeld/Mackenzell (DE); Christof Kruse, Wenden (DE)

(73) Assignee: Boart Longyear Company, Salt Lake City, UT (US)

( * ) Notice: Subject to any disclaimer, the term of this patent is extended or adjusted under 35 U.S.C. 154(b) by 278 days.

(21) Appl. No.: 17/312,243

(22) PCT Filed: Dec. 18, 2019

(86) PCT No.: PCT/US2019/067079
§ 371 (c)(1),
(2) Date: Jun. 9, 2021

(87) PCT Pub. No.: WO2020/132007
PCT Pub. Date: Jun. 25, 2020

(65) Prior Publication Data

US 2022/0025721 A1 Jan. 27, 2022

Related U.S. Application Data

(60) Provisional application No. 62/784,000, filed on Dec. 21, 2018.

(51) Int. Cl.
*E21B 21/015* (2006.01)
*E02D 5/46* (2006.01)
*E21B 17/042* (2006.01)

(52) U.S. Cl.
CPC ..... *E21B 21/015* (2013.01); *E21B 17/042* (2013.01); *E02D 5/46* (2013.01)

(58) Field of Classification Search
CPC ..... E21B 21/015; E21B 17/042; E21B 3/02; E21B 7/002; E21B 7/02; E21B 4/003;
(Continued)

(56) References Cited

U.S. PATENT DOCUMENTS 4,298,073 A 11/1981 Yates
4,505,333 A * 3/1985 Ricks, Sr. ..... E21B 43/00 166/267

(Continued)

FOREIGN PATENT DOCUMENTS

DE 19906687 A1 8/2000
WO WO 2004/001240 A1 12/2003

(Continued)

OTHER PUBLICATIONS

EPO Examination Report for copending EPO application No. 19 90 0653, dated Jul. 28, 2022.
PCT Search Report and Written Opinion for PCT/2019/067079.

*Primary Examiner* — Tara Schimpf
*Assistant Examiner* — Yanick A Akaragwe
(74) *Attorney, Agent, or Firm* — Ballard Spahr LLP

(57) ABSTRACT

A high pressure injection flushing head includes a flushing body comprising an upper body portion, and a lower body portion coupled to the upper body portion. The upper body portion and the lower body portion cooperate to define a bore. A shaft is rotatably disposed at least partially within the bore. A plurality of rotary elements are configured to facilitate rotational movement of the shaft relative to the flushing body. The flushing body comprises a lubrication system having a plurality of grease nipples, and a network of pathways in fluid communication with the grease nipples that are configured to deliver grease to the rotary bearings. The flushing head couples to an adapter via a flanged
(Continued)

connection so that the flushing head can be adapted for use with a plurality of drill rod types.

22 Claims, 17 Drawing Sheets

(58) Field of Classification Search
CPC ..... E21B 10/22; E21B 10/23; E21B 10/24; E21B 10/246; E21B 10/25; E21B 37/00; E02D 5/46; E02D 3/12; E02D 5/665; E02D 2250/003
USPC ..... 405/266, 269
See application file for complete search history.

(56) References Cited

U.S. PATENT DOCUMENTS 4,560,001 A * 12/1985 Gonzales ..... E21B 33/085 166/84.3
4,613,002 A * 9/1986 Pittman ..... E21B 4/003 384/93
4,620,601 A * 11/1986 Nagel ..... E21B 4/003 384/282
4,946,201 A * 8/1990 Tai ..... E21B 17/042 285/94
5,647,444 A * 7/1997 Williams ..... E21B 33/085 166/84.1
6,293,628 B1 * 9/2001 Schwoebel ..... E21D 9/12 299/56
6,330,860 B1 12/2001 Kang
7,520,341 B1 4/2009 DeVall
7,591,328 B2 * 9/2009 Guede ..... E21D 20/028 405/269
2001/0007831 A1 6/2001 Edi
2003/0205898 A1 11/2003 Baldwin et al.
2007/0251699 A1 4/2007 Wells et al.
2010/0078221 A1 4/2010 Kruse et al.
2010/0326730 A1 * 12/2010 Prill ..... F16C 19/30 310/90
2011/0132687 A1 6/2011 Ifield
2012/0157962 A1 6/2012 Canton et al.
2012/0216521 A1 8/2012 Wrede et al.
2017/0183946 A1 * 6/2017 Tolman ..... E21B 47/09
2018/0021850 A1 1/2018 Ruxanda et al.
2019/0352966 A1 * 11/2019 Leung ..... F16C 33/121

FOREIGN PATENT DOCUMENTS

WO WO 2005/121493 A2 12/2005
WO WO 2017/153390 A1 9/2017

* cited by examiner

HIGH PRESSURE INJECTION FLUSHING HEADS AND SYSTEMS INCLUDING SUCH FLUSHING HEADS

CROSS-REFERENCE TO RELATED APPLICATION

This is a U.S. National Phase Application of International Application No. PCT/US2019/067079, filed Dec. 18, 2019, which claims priority to and the benefit of U.S. Provisional Patent Application No. 62/784,000, filed Dec. 21, 2018, which applications are hereby incorporated herein by reference in their entireties.

FIELD

This application relates to injection systems for creating concrete columns and, more particularly, to high pressure injection flushing heads for such systems.

BACKGROUND

High Pressure Injection (HPI) systems can be used to prepare concrete columns in the ground for stabilization and ground sealing. Referring to FIGS. 1-4, conventionally, a high pressure injection system 10 includes a drilling rig 12 that has a mast 14. An HPI flushing head 16 mounts atop the mast, and one or more HPI drill rods 18 connect the flushing head 16 to a nozzle fastener 20, which, in turn, connects to a drill bit 22.

Drilling rig 12 can drill a pilot hole 8 into a ground 6 to a desired depth of a column. During a conventional drilling step (shown to the far left of FIG. 1), drill rods equipped with a jet nozzle holder and a drill bit are used to drill a jet grouting hole down to the required depth. A flushing medium (e.g., water at up to 60 bar) can be pumped through the drill rods 18, past a pressure-sensitive valve 24 in the nozzle fastener 20, to the drill bit 22. Once the desired depth is reached, high pressure grout flushing hoses can be affixed to the flushing head 16. The HPI system 10 can then pump grout and optionally air and water down into the hole, through the nozzle fastener 20, to mix with the soil. (See the second process depicted in FIG. 1). As high pressure grout is delivered down to the nozzle fastener 20, the valve 24 closes under the high pressure (e.g., up to 600 bar), preventing grout from being delivered to the drill bit 22 and instead routing the grout flow to nozzles 28. The nozzles 28 can be selected from various sizes, depending on the soil properties and ground conditions. The grout spray from the nozzles can cut through the ground to create a mixture of soil and grout. The drilling rig 12 can lift and optionally pivot the nozzle fastener 20 to create a column of the soil and grout mixture that forms a hard column 26. (See the third process depicted in FIG. 1). A chuck 30 couples to a circumferential surface of a drill rod 18 and controls the feed (e.g., longitudinal motion parallel to the drill mast's axis) and rotation of the drill string, which includes the drill rods 18, flushing head 16, and drill bit 22. Because the flushing head 16 constantly prepares the concrete, the flushing head is mounted on the top of the drill string and is guided on the lightweight extension mast 14 of the drill rig 12. In another configuration for use in height-limited applications, the flushing head is mounted underneath a top drive head without a chuck. Optionally, multiple columns of soil/grout can be formed and/or connected together as shown in the fourth process depicted at the far right in FIG. 1.

HPI systems can be configured as single phase, dual phase, or triple phase systems. Single phase systems can deliver only high pressure concrete to the nozzle fastener. Dual phase systems can include a high pressure concrete channel and an air or water low pressure channel. Triple phase systems can include a high pressure concrete or water channel, a medium pressure concrete or water channel, and a low pressure air channel.

Conventionally, various HPI rod sizes can be used, each size requiring a correspondingly sized HPI flushing head, so the flushing head has to be changed to match the selected HPI rod. Accordingly, providing a flushing head that can operably couple to plurality of rod sizes can be beneficial.

Conventionally, HPI flushing heads are large and heavy. Because they mount to the top of the mast, their weight can limit the height at which the HPI flushing head can be mounted. This correspondingly limits the size of the drill rods used. Accordingly, lowering the size and weight of the HPI flushing head can allow for a more versatile high pressure injection system.

Conventionally, HPI flushing heads have lubrication systems that require frequent maintenance. Because the HPI flushing head is atop a drilling mast, this can be a difficult task. Accordingly, reducing the maintenance frequency can be desirable.

SUMMARY

Disclosed herein, in one aspect, is a high pressure injection flushing head.

The high pressure injection flushing head can comprise a flushing body comprising an upper body portion and a lower body portion coupled to the upper body portion. The upper body portion and the lower body portion can cooperate to define a bore. A shaft can be rotatably disposed at least partially within the bore. A plurality of rotary elements can be configured to facilitate rotational movement of the shaft relative to the flushing body. The flushing body can comprise a lubrication system having at least one lubricant nipple and a network of pathways in fluid communication with the at least one lubricant nipple that are configured to deliver grease to the rotary elements.

The shaft can define a flange that is configured to couple to a corresponding flange of a rod adapter.

Each lubricant nipple of the at least one lubricant nipple can be in fluid communication, via the network of pathways, with a maximum of two rotary elements of the plurality of rotary elements.

The lubrication system can further comprise at least one grease pressure indicator in fluid communication with the at least one lubricant nipple.

The upper body portion and the lower body portion of the flushing body can be coupled together by at least one screw.

The high pressure injection flushing head can further comprise a wear bushing rotatably disposed within the bore.

The wear bushing can comprise at least one of a tungsten carbide nickel coating, a chromized coating, or a QPQ prepared surface.

The high pressure injection flushing head can further comprise a high pressure hose coupling.

The high pressure hose coupling can be threadedly coupled to the flushing body so that rotation of the high pressure hose coupling with respect to the flushing body is configured to move the high pressure hose coupling axially with respect to the wear bushing to define a select axial spacing between the high pressure hose coupling and the wear bushing.

The select axial spacing between the high pressure hose coupling and the wear bushing can be less than 3 millimeters.

The select axial spacing between the high pressure hose coupling and the wear bushing can be less than 1 millimeter.

The select axial spacing between the high pressure hose coupling and the wear bushing can be less than 0.1 millimeter.

The high pressure injection flushing head can further comprise an axially compressible seal disposed between the wear bushing and the high pressure hose coupling.

The high pressure hose coupling can have a diameter of 2 inches or more.

The high pressure hose coupling can have a diameter of 1.5 inches or less.

The plurality of rotary elements can comprise a thrust bearing in engagement between the upper body portion of the flushing body and the shaft, a radial bearing in engagement between the lower body portion of the flushing body and the shaft, and tapered roller bearing in engagement between the flushing body and the shaft, wherein the tapered roller bearing is disposed between the radial bearing and the thrust bearing with respect to a rotational axis of the high pressure injection flushing head.

The shaft can define an inner bore having an inner diameter, wherein the diameter of the inner bore of the shaft is between 34.5 and 45 millimeters.

An apparatus can comprise the high pressure injection flushing head and a rod adapter having a first end that is attached to the flushing head and a second end that is configured to attach to a drill rod.

An apparatus can comprise a high pressure injection flushing head and a pressurized lubrication source that is configured to provide a lubricant to the high pressure injection flushing head. A lubricant diverter can be is configured to receive the lubricant from the pressurized lubricant source. The lubricant diverter can define at least a portion of a conduit between the grease pump and the at least one lubricant nipple.

The pressurized lubrication source can comprise a grease supply and a grease pump that is configured to pump grease from the grease supply to the high pressure injection flushing head.

The pressurized lubrication source can comprise a pressurized lubricant cartridge.

A method can comprise decoupling the first drill rod from the first rod adapter of the apparatus and replacing the rod adapter with a second rod adapter different than the rod adapter in at least one of size or profile. Replacing the rod adapter with a second rod adapter can comprise attaching a first end of the second rod adapter to the flushing head and engaging a second drill rod with a second end of the second rod adapter. The second drill rod can be different from the first drill rod in at least one of size, profile, or thread type.

A high pressure injection flushing head can comprise a flushing body comprising an upper body portion and a lower body portion coupled to the upper body portion. The upper body portion and the lower body portion can cooperate to define a bore. A shaft can be rotatably disposed at least partially within the bore. A plurality of rotary elements can be configured to facilitate rotational movement of the shaft relative to the flushing body. The plurality of rotary elements can comprise a thrust bearing in engagement between the upper body portion of the flushing body and the shaft, a radial bearing in engagement between the lower body portion of the flushing body and the shaft, and tapered roller bearing in engagement between the flushing body and the shaft. The tapered roller bearing can be disposed between the radial bearing and the thrust bearing with respect to a rotational axis of the high pressure injection flushing head.

A high pressure injection flushing head can comprise a flushing body comprising an upper body portion and a lower body portion coupled to the upper body portion. The upper body portion and the lower body portion can cooperate to define a bore. A shaft can be rotatably disposed at least partially within the bore. A plurality of rotary elements can be configured to facilitate rotational movement of the shaft relative to the flushing body. A wear bushing can be rotatably disposed within the bore. A high pressure hose coupling can be threadedly coupled to the flushing body so that rotation of the high pressure hose coupling with respect to the flushing body is configured to move the high pressure hose coupling axially with respect to the wear bushing to define a select axial spacing between the high pressure hose coupling and the wear bushing.

Additional advantages of the disclosed system and method will be set forth in part in the description which follows, and in part will be understood from the description, or may be learned by practice of the disclosed system and method. The advantages of the disclosed system and method will be realized and attained by means of the elements and combinations particularly pointed out in the appended claims. It is to be understood that both the foregoing general description and the following detailed description are exemplary and explanatory only and are not restrictive of the invention as claimed.

BRIEF DESCRIPTION OF THE DRAWINGS

The accompanying drawings, which are incorporated in and constitute a part of this specification, illustrate several embodiments of the disclosed apparatus, system, and method and together with the description, serve to explain the principles of the disclosed apparatus, system, and method.

DETAILED DESCRIPTION

Figure 1:
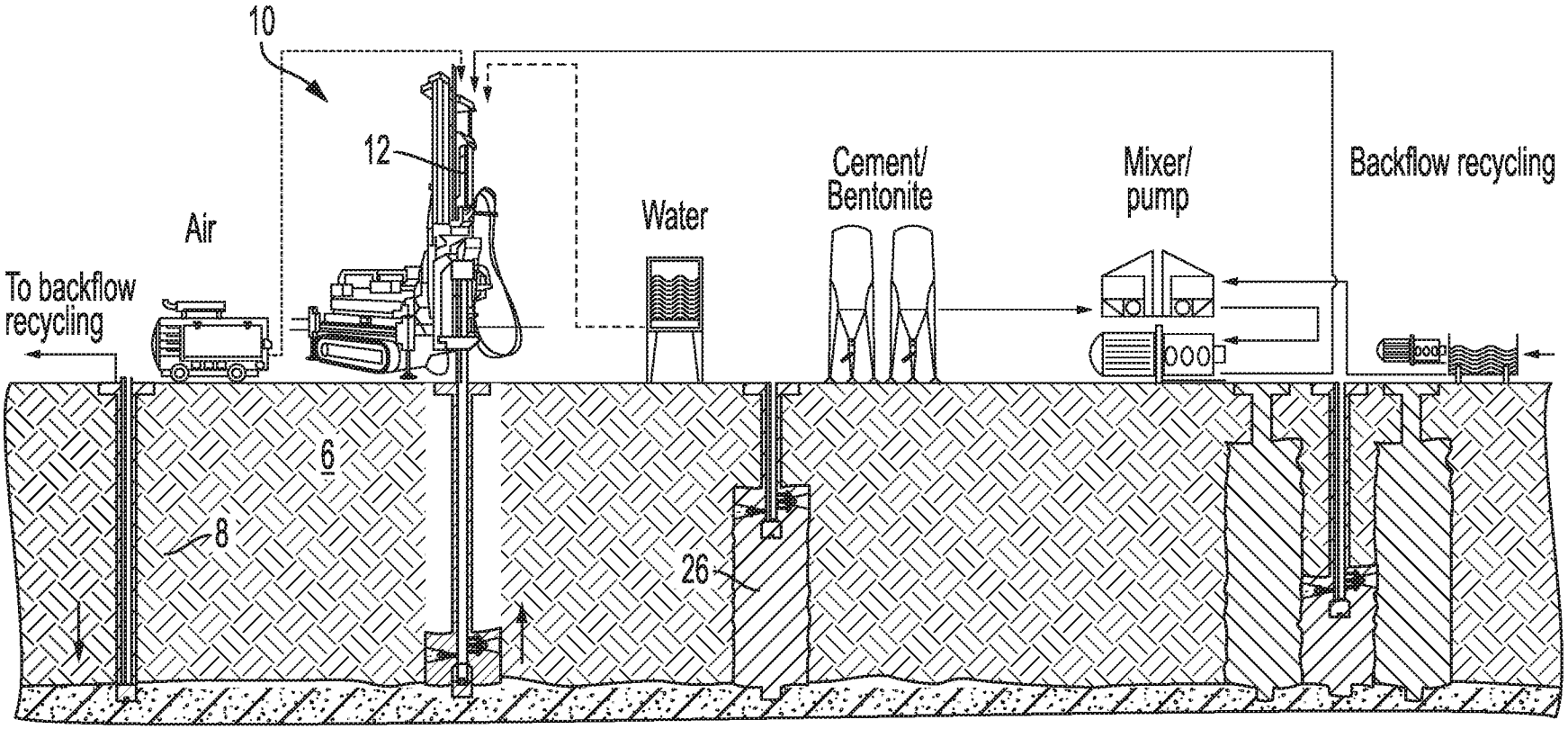
FIG. 1 is a prior art schematic of a high pressure injection system that further illustrates four phases of high pressure injection column forming.
Figure 2:
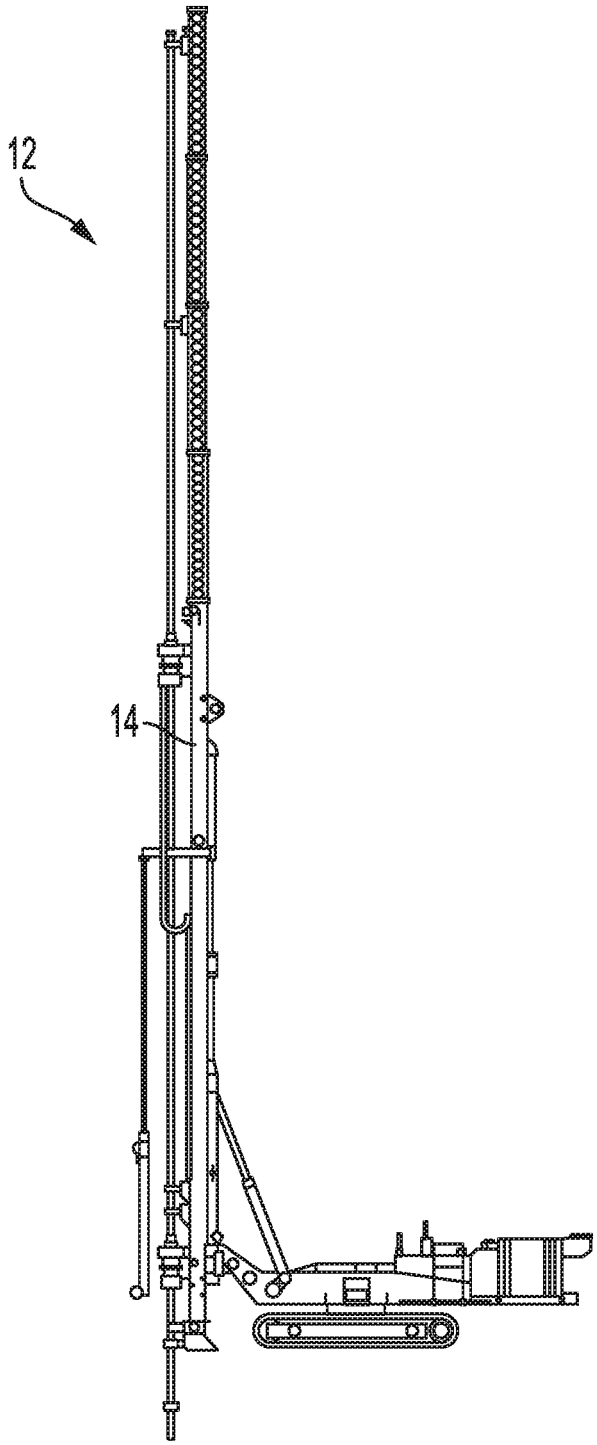
FIG. 2 is an illustration of a prior art drilling rig for use in the injection system of FIG. 1.
Figure 3:
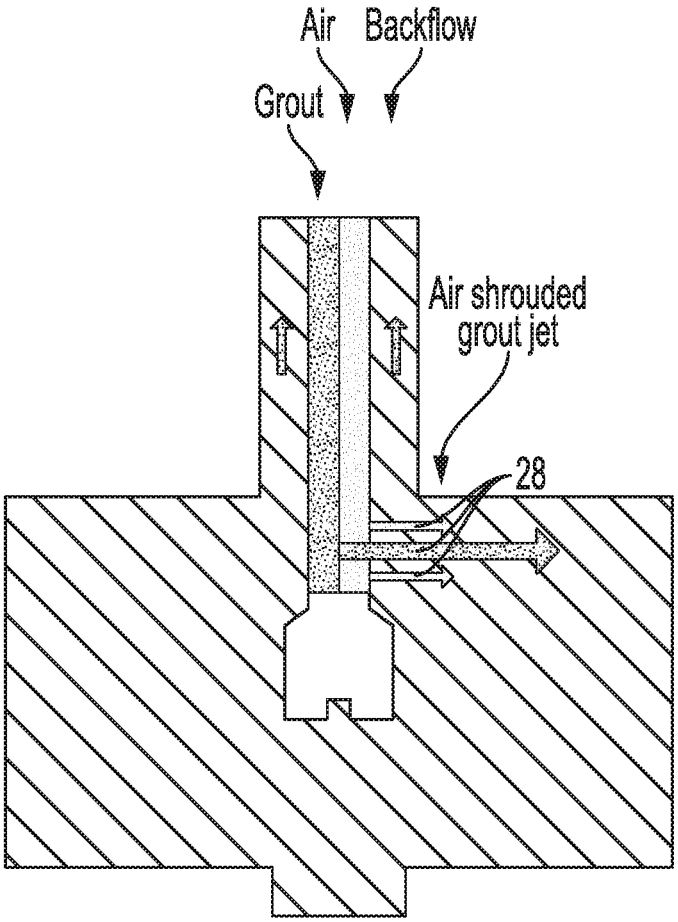
FIG. 3 is a schematic of a two-phase high pressure injection process.
Figure 4:
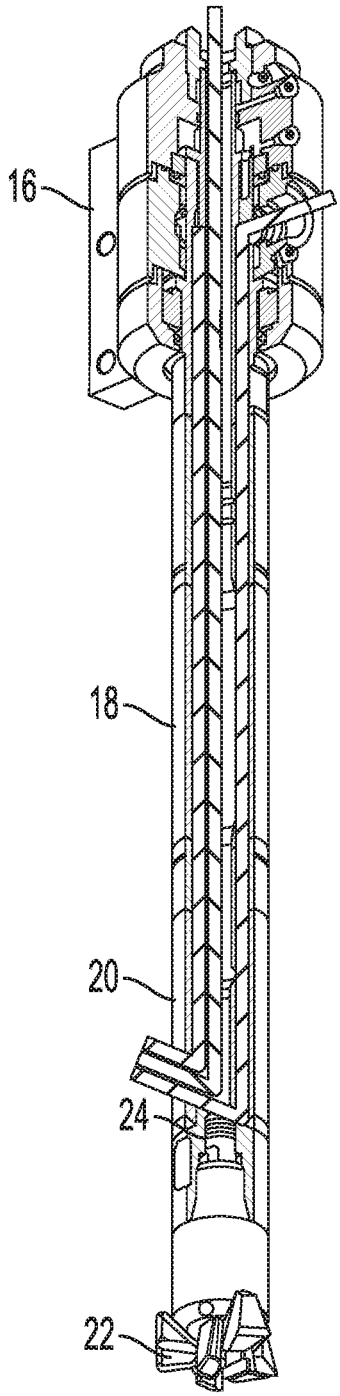
FIG. 4 is partial cutaway perspective view of a portion of a high pressure injection system (embodied as a dual phase system) as in FIG. 1, including a high pressure injection flushing head, a drill string, a nozzle fastener, and a drill bit.

The disclosed system and method may be understood more readily by reference to the following detailed description of particular embodiments and the examples included therein and to the Figures and their previous and following description.

A. Definitions

It is to be understood that the terminology used herein is for the purpose of describing particular embodiments only, and is not intended to limit the scope of the present invention which will be limited only by the appended claims.

It must be noted that as used herein and in the appended claims, the singular forms "a", "an", and "the" include plural references unless the context clearly dictates otherwise. Thus, for example, reference to "a nipple" includes a plurality of such nipple, and reference to "the nipple" is a reference to one or more nipples and equivalents thereof known to those skilled in the art, and so forth.

"Optional" or "optionally" means that the subsequently described event, circumstance, or material may or may not occur or be present, and that the description includes instances where the event, circumstance, or material occurs or is present and instances where it does not occur or is not present.

Ranges may be expressed herein as from "about" one particular value, and/or to "about" another particular value. When such a range is expressed, also specifically contemplated and considered disclosed is the range from the one particular value and/or to the other particular value unless the context specifically indicates otherwise. Similarly, when values are expressed as approximations, by use of the antecedent "about," it will be understood that the particular value forms another, specifically contemplated embodiment that should be considered disclosed unless the context specifically indicates otherwise. It will be further understood that the endpoints of each of the ranges are significant both in relation to the other endpoint, and independently of the other endpoint unless the context specifically indicates otherwise. Finally, it should be understood that all of the individual values and sub-ranges of values contained within an explicitly disclosed range are also specifically contemplated and should be considered disclosed unless the context specifically indicates otherwise. The foregoing applies regardless of whether in particular cases some or all of these embodiments are explicitly disclosed.

Unless defined otherwise, all technical and scientific terms used herein have the same meanings as commonly understood by one of skill in the art to which the disclosed apparatus, system, and method belong. Although any apparatus, systems, and methods and materials similar or equivalent to those described herein can be used in the practice or testing of the present apparatus, system, and method, the particularly useful methods, devices, systems, and materials are as described.

Throughout the description and claims of this specification, the word "comprise" and variations of the word, such as "comprising" and "comprises," means "including but not limited to," and is not intended to exclude, for example, other additives, components, integers or steps. In particular, in methods stated as comprising one or more steps or operations it is specifically contemplated that each step comprises what is listed (unless that step includes a limiting term such as "consisting of"), meaning that each step is not intended to exclude, for example, other additives, components, integers or steps that are not listed in the step.

B. High Pressure Injection Flushing Head

Disclosed herein is a high pressure injection flushing head. Although the disclosed embodiment is directed to a dual phase flushing head, it should be understood that various features can be applied to other configurations, such as single and triple phase flushing heads. Referring to FIGS. 5-15, a dual phase flushing head 100 can include a flushing body 101 having a low pressure body portion 102, which can be a lower body portion when the flushing head 100 is oriented for vertical downward drilling, and a high pressure body portion 104, which can be an upper body portion when the flushing head 100 is oriented for vertical downward drilling. Thus, as used herein the term "upper body portion" refers to the portion of the flushing body that is farthest away from the base/bottom of the drill hole, whereas the term "lower body portion" refers to the portion of the flushing body that is closest to the base/bottom of the drill hole. A drive shaft 105 can be rotatably disposed at least partially within the flushing body 101. The drive shaft 105 can include a main drive shaft 106 and an inner drive shaft 108. The main drive shaft 106 and the low pressure body portion 102 can define a low pressure area 110, and the inner drive shaft 108 and the high pressure body portion 104 can define a high pressure area 112. Optionally, the low pressure area 110 can be configured for pressures of up to 100 bar, and the high pressure area 112 can be configured for pressures of up to 600 bar. Each of the low and high pressure sections can use different sealing components (e.g., O-rings) and bearings. The low pressure body portion and the high pressure body portion can optionally be coupled via body screws 114 for quick disassembly and reassembly. In contrast, in conventional designs, the low and high pressure sections couple via bayonette couplings. Attachment via screws as disclosed herein allows for a smaller, more compact, and lighter (less heavy) configuration.

The drive shaft 105 can further include an upper flange 134, defined by the inner drive shaft 108, and a connection flange 136. A ring 135 can have an inner diameter that is less than the inner diameter of an opening of the upper flange 134 of the drive shaft 105 so that the ring 135 and upper flange of the drive shaft can define an annular recess that is configured to receive an annular lip 183 extending radially from a wear bushing 182. A plurality of shaft screws 130 can extend through the ring 135, through the upper flange 134, through a top flange of the inner drive shaft 108, through the connection flange 136, and into threaded holes in the main drive shaft 106 to form the assembled drive shaft 105. The wear bushing 182 can be coupled to the rotating assembly via receipt of the annular lip 183 into the annular recess defined by the drive shaft and the ring 135. The drive shaft 105 can be rotatably supported by a small ball bearing 122 and a large taper roller bearing 124. The tapered roller bearing 124 can be disposed at a location slightly above a plane 132 below which (i.e. in the axial direction toward an end that couples to a drill rod adapter as disclosed further herein) the low pressure area 110 begins. The roller bearing 124 can engage the drive shaft 105 at the connection flange 136. The roller bearing 124 can support the axial load of both the main drive shaft 106 and the inner drive shaft 108. The drive shaft 105 can further be supported by an axial bearing 166 that can be disposed between the connection flange 136 and the high pressure body portion 104. The interface between the main drive shaft 106 and the inner drive shaft 108 can be sealed by at least one and preferably at least two seals (e.g., O-rings 170).

The low pressure body portion 102 can include a low pressure fluid connection 116 at a duct that leads from an exterior of the low pressure body portion to a circumferential interior groove 140. The circumferential groove 140 can align with at least one hole 141 in the main drive shaft 106 so that low pressure fluid can travel from the low pressure fluid connection 116 to the low pressure area 110, which can be an annulus between the interior surface of the main drive shaft 106 and the inner drive shaft 108. One or more slide rings 142 (e.g., rota slide rings), that are adapted for rotation and sliding motion are disposed on each side of the groove, seal the low pressure area 110 between the low pressure body portion 102 and the main drive shaft 106. Although only two slide rings 142 are depicted in the drawings, it is contemplated that three or more slide rings can be used.

Figure 5:
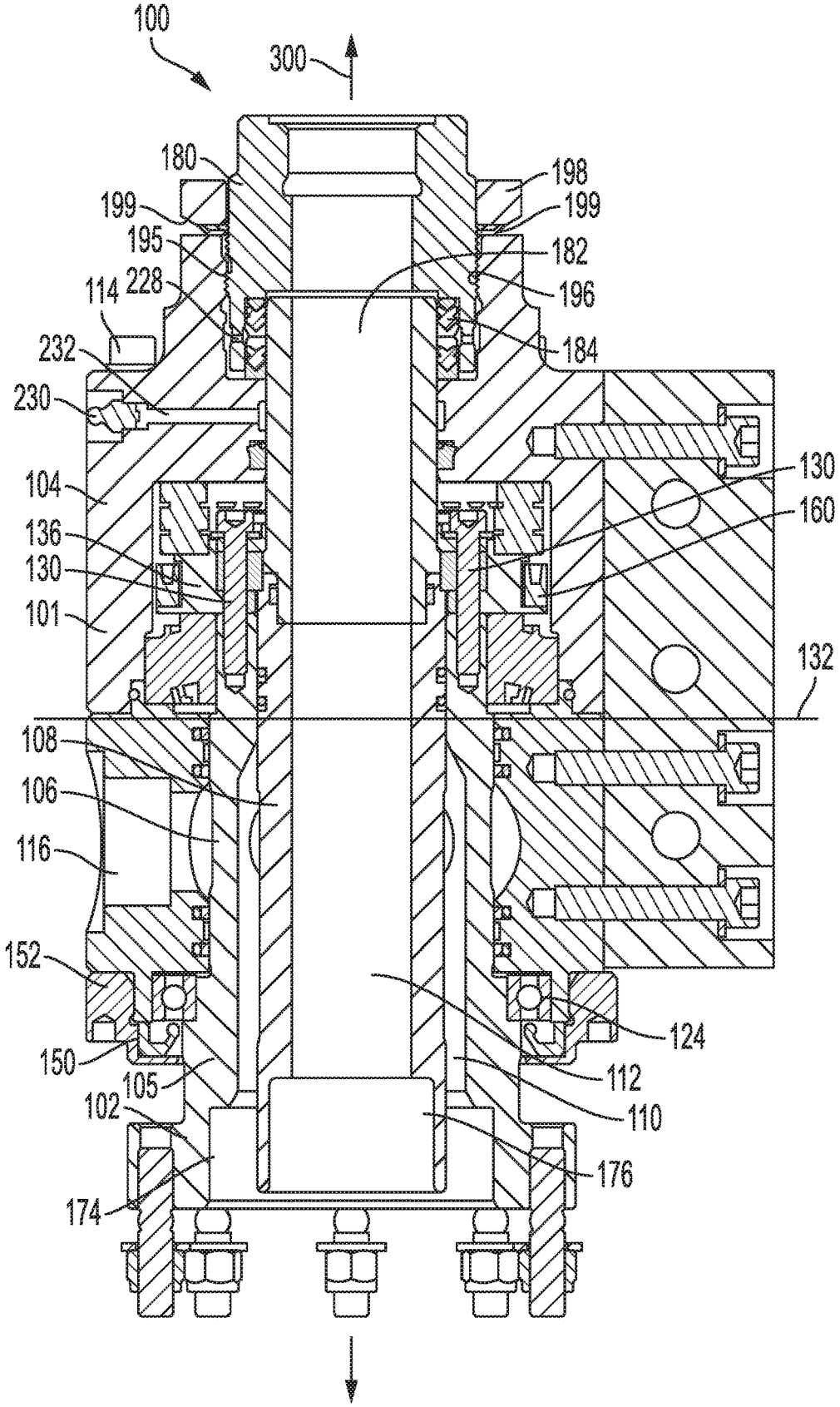
FIG. 5 is a cutaway of a high pressure injection flushing head according to an exemplary implementation as disclosed herein.
Figure 6:
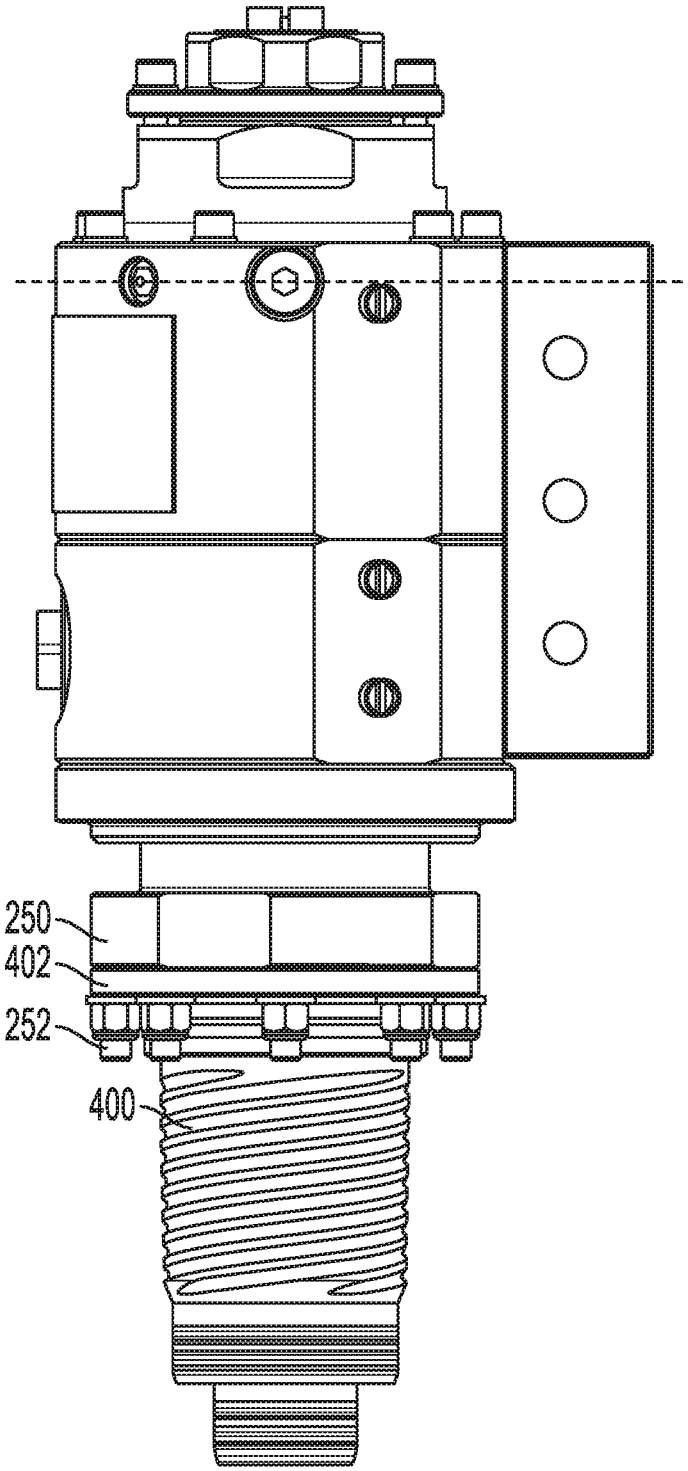
FIG. 6 is a side view of the high pressure injection flushing head as in FIG. 5 with a rod adapter.
Figure 7:
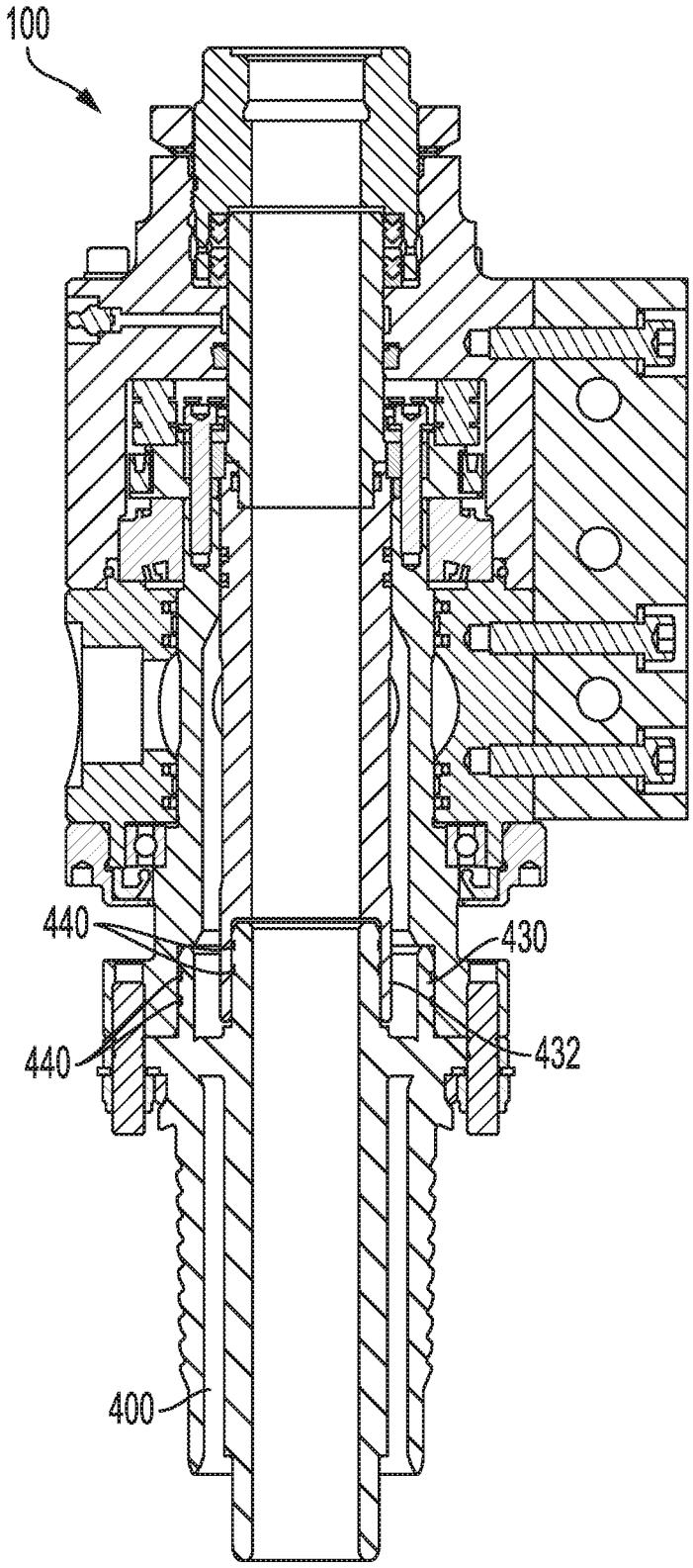
FIG. 7 is a cutaway of a high pressure injection flushing head as in FIG. 5 coupled with a rod adapter.
Figure 8A:
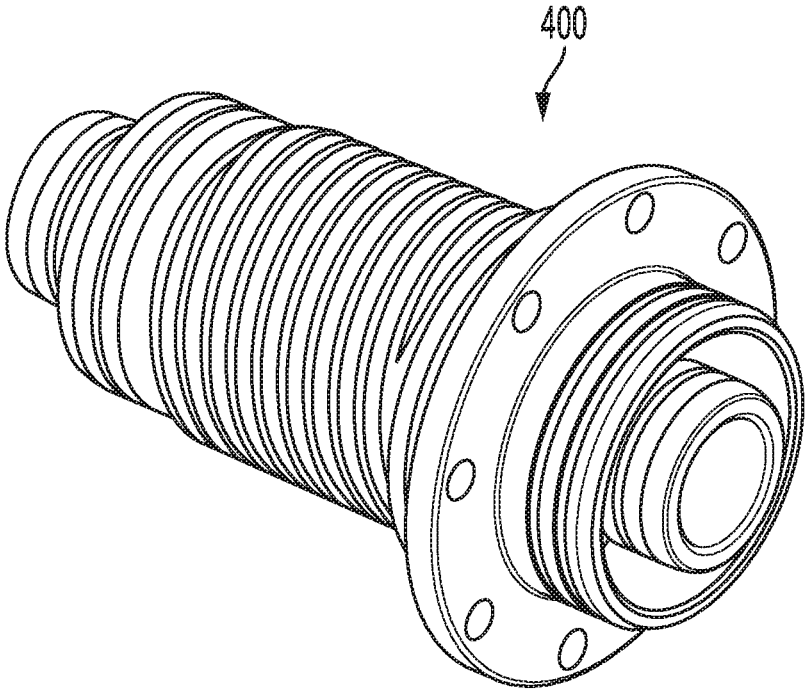
FIG. 8A is a perspective view of a first rod adapter for use with the high pressure injection flushing head in FIG. 5.
Figure 8B:
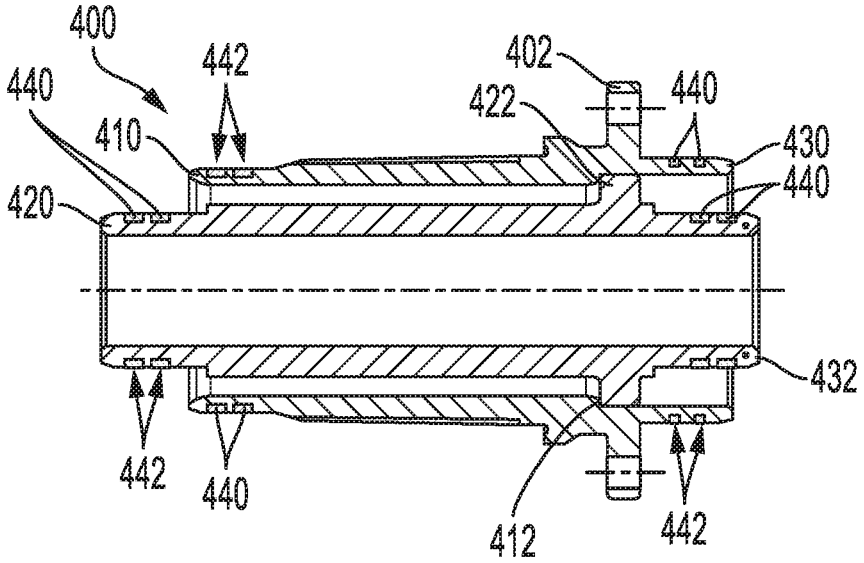
FIG. 8B is a cross sectional view of the rod adapter of FIG. 8A.
Figure 9:
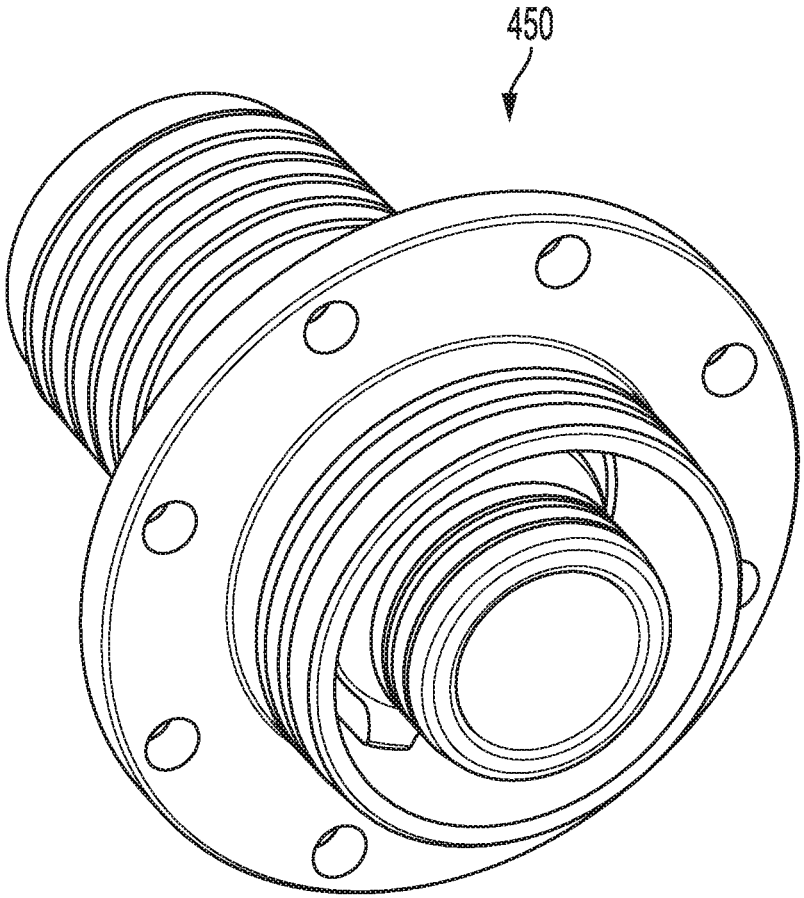
FIG. 9 is a second rod adapter for use with the high pressure injection flushing head in FIG. 5.
Figure 10:
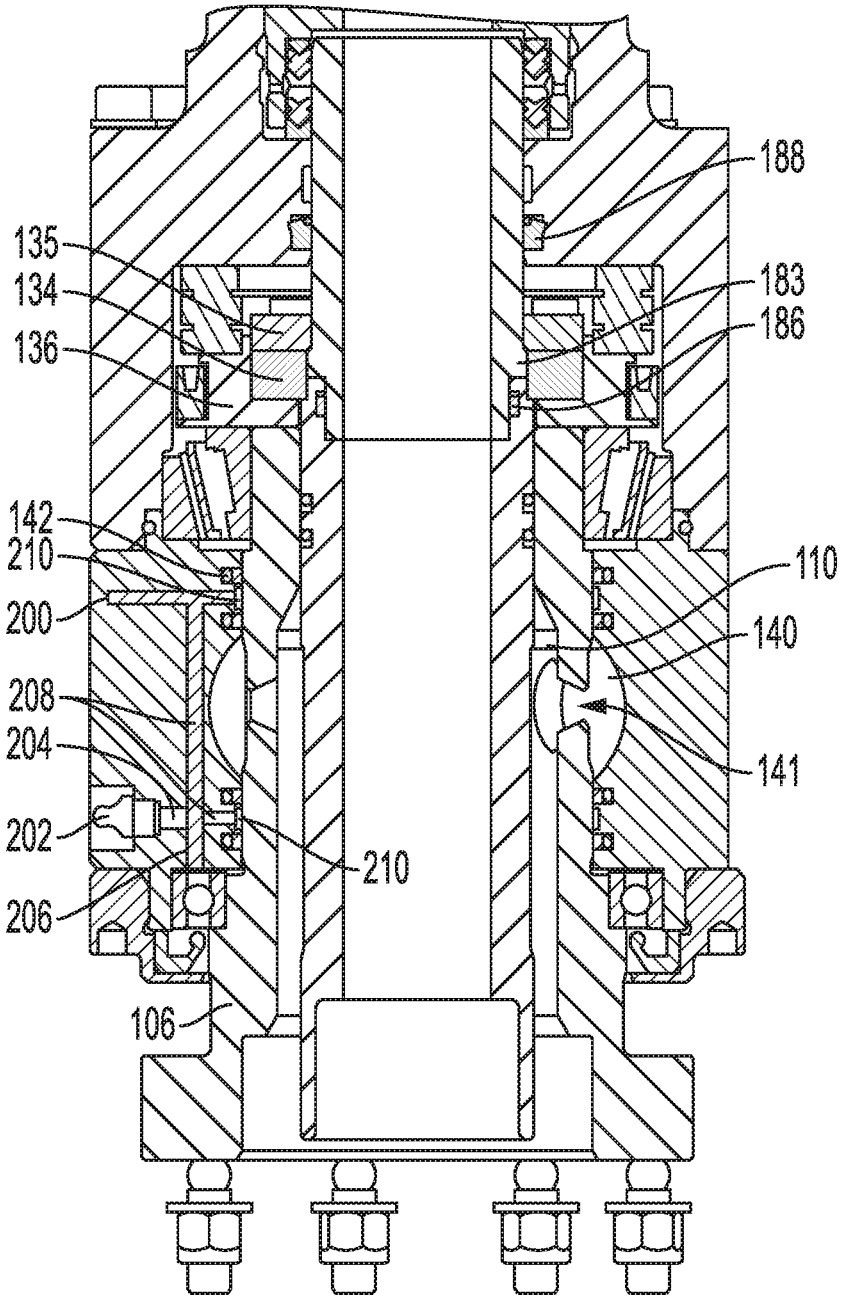
FIG. 10 is a cutaway of the high pressure injection flushing head as in FIG. 5.
Figure 11:
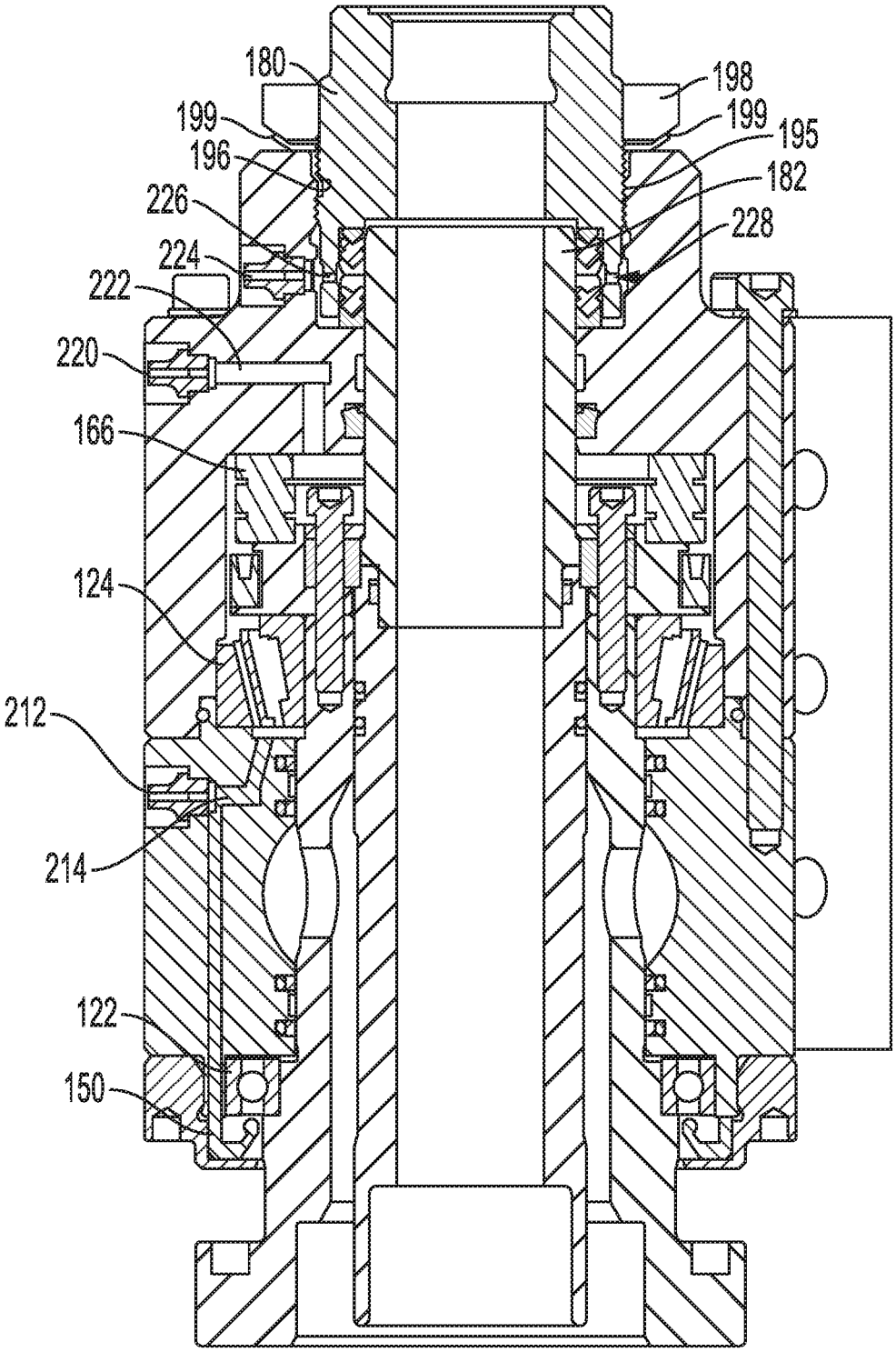
FIG. 11 is a cutaway of the high pressure injection flushing head as in FIG. 5.

The connection flange 136 acts as a boundary between the low pressure area 110 and the high pressure area 108. Accordingly, a rotation lip seal 160, which, as shown in FIG. 5, can abut and circumferentially enclose a portion of the connection flange 136, provides a seal between the high pressure body portion 104 and the drive shaft 105. The rotation lip seal 160 can have a V-shaped cross section having its opening facing the high pressure side so that the high pressure grout cannot force its way past the seal.

A rotary shaft seal 150 can be disposed within an end cap 152 that attaches to the lower pressure body portion 102. The rotary flange 150 can prevent dirt from getting into the roller bearing 124 and the interior of the flushing body 101.

High pressure grout can be delivered to the head via a flushing hose coupling 180, through a wear bushing 182, and into the inner drive shaft 108. The grout can be abrasive. The flushing hose coupling can have a central axis that is coaxial with a rotational axis 300 of the flushing head. Accordingly, minimizing discontinuous interfaces between components of the flushing head and flushing hose coupling can increase the lifetimes of those respective components. A roof collar seal set 184 can be disposed between the hose coupling 180 and the wear bushing 182. The roof collar seal set 184 can optionally comprise V-seals that have a V-shaped cross-section (e.g., an outwardly facing V-shaped cross-section) as is known in the art. As the roof collar seal set is compressed, the lips of the respective V-seals can be forced axially.

The flushing hose coupling 180 can be tightened down to adjust the roof collar seal set 184. The hose coupling 180 can define external threads 195 that are receivable into internal threads 196 of the high pressure body portion 104. The hose coupling 180 can further define spanner (wrench) flats 197 so that the hose coupling 180 can be rotated to select the axial spacing between the hose coupling and the wear bushing 182. An internally threaded flange 198 can engage the external threads 195 on the hose coupling to screw down to bias a locknut 199 between the high pressure body portion 104 and the internally threaded flange. One or more screws 194 can fix the rotational position of the internally threaded flange 198 with respect to the high pressure body portion 104. An interior of the hose coupling 180 can receive a plug 190 (FIG. 15) that has a protruding surface 192 for gripping and removing the plug. In some aspects, the flushing hose coupling can be tightened down so that its bottom face is flush against an opposing face of the wear bushing 182. In further embodiments, the spacing between the flushing hose coupling and the wear bushing can be less than 3 millimeters. In further embodiments, the spacing between the flushing hose coupling and the wear bushing can be less than 2 millimeters, 1.5 millimeters, 1 millimeter, or 0.1 millimeter. For example, the spacing may be less than 3 millimeters for a two-inch hose coupling, and the spacing can be less than 0.1 millimeter for a 1½ inch or smaller hose coupling.

It is contemplated that the adjustable position between the hose coupling 180 and the wear bushing 182 can enhance the life of the roof collar seal set 184. For example, the roof collar seal set 184 can initially be compressed between the hose coupling and the wear bushing at a first, low pressure. As the seal wears, the seal set can begin to leak. Thus, the hose coupling 180 can be tightened down against the wear bushing 182 to increase the pressure on the roof collar seal set 184 to reduce or stop the leaking, thereby extending the lifetime of the coupling. The hose coupling can repeatedly be tightened down as necessary to reduce leaking.

Figure 17:
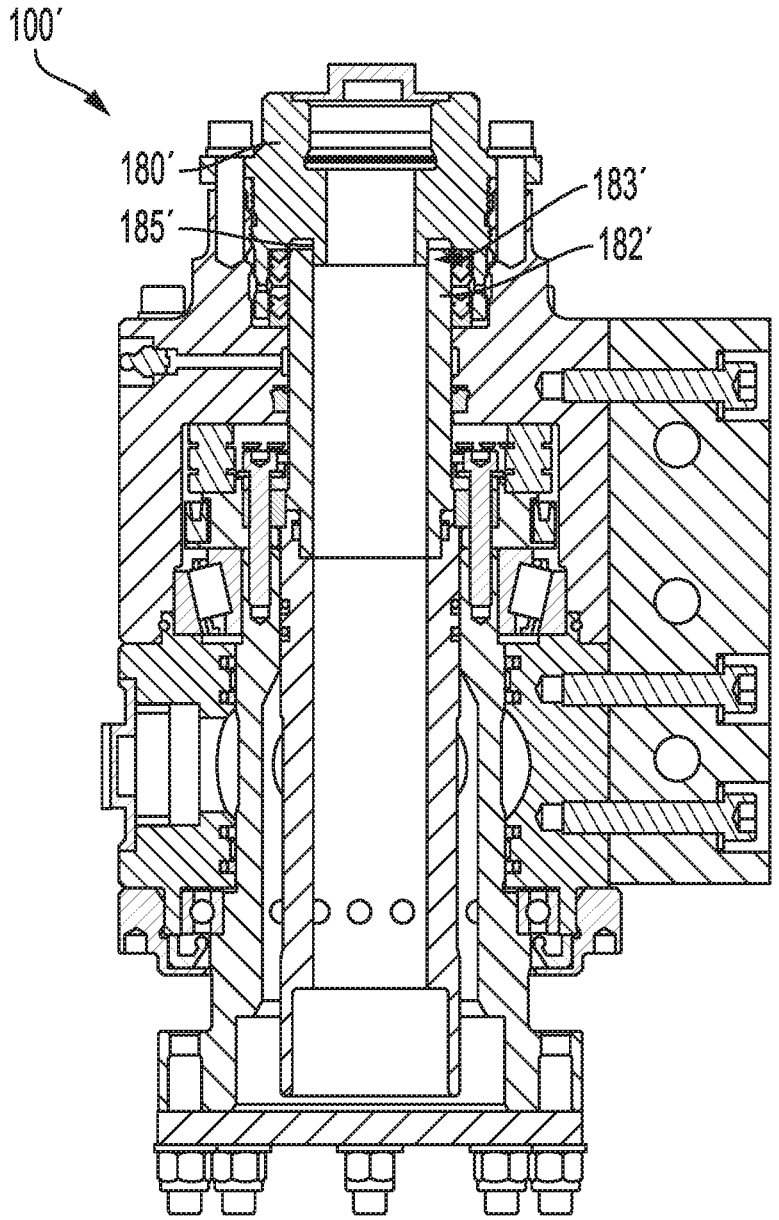
FIG. 17 is a section view of an alternative flushing head in accordance with embodiments of the present disclosure having a labyrinth seal between its hose coupling and its wear bushing.

Referring to FIG. 17, in further optional embodiments, a flushing head 100' can include a labyrinth seal 183' between a flushing hose coupling 180' and a wear bushing 182'. In this way, the spacing between the flushing hose coupling and the wear bushing can be reduced to 0.1 millimeters or less. This decreased spacing is a substantial improvement over conventional flushing heads, which typically required significantly greater spacing. As an example, the labyrinth seal 183' can include overlapping and interlocking annular protrusions that create a path that inhibits leakage between the respective components. That is, a portion of the top end of wear bushing 182' can be received within an annular recess 185'. Accordingly, instead of having a relatively large gap between opposing planar faces parallel to the flushing head's rotational axis, the labyrinth seal 183' provides a relatively smaller gap between an interior surface of the wear bushing 182' and an opposing face of the flushing hose coupling's annular recess 185'.

Referring again to FIGS. 5-15, the pressure of the seal set 184 can cause wear on the wear bushing at its engagement area around the circumference of the wear bushing's exterior. Accordingly, the engagement area can be hardened via chrome plating, a carburized surface, tungsten carbide nickel coating, a chromized coating, or a quench-polish-quench (QPQ) preparation. The end of the wear bushing 182 opposite the roof collar set is sealed via an O-ring 186 against the inner drive shaft 108. A rotation lip seal 188 is disposed within the high pressure body portion 104 and engages an exterior surface of the wear bushing 182. The wear bushing 182 is disposed in the flushing head 100 so that it can be easily removed and replaced. According to one aspect, all of the inner diameters of the hose coupling 180, the wear bushing 182, and the inner drive shaft 108 are at least 34.5 millimeters and up to 45 millimeters, and optionally 43 millimeters. In this way, the inner diameter is configured to receive a deviation tool having the most common diameter. Further, the interface between the hose coupling 180 and the wear bushing 182 and the interface between the wear bushing 182 and the inner drive shaft 108 can both be smooth and continuous.

A lubrication system 200 can be configured for receiving a plurality of different lubricants (e.g., greases) at various pressures, viscosities and quantities. Accordingly, the lubrication system 200 can comprise a lower grease nipple 202 on the lower body portion 102. The first grease nipple 202 can be coupled with a grease supply. A conduit 204 can have a first branch 206 that extends from the first grease nipple 202 to the rotary shaft seal 150. The conduit 204 can have a second branch 208 that extends from the first grease nipple 202 to the slide rings 142 (e.g., to a pair of annular grooves 210 in lower body portion 102, each groove disposed between a respective pair of slide rings 142). The lubrication system 200 can further include a second grease nipple 212 in the lower body portion 102 that is in fluid communication with the rotary shaft seal 150 and the tapered roller bearing 124 via a conduit 214. The lubrication system 200 can further include a third grease nipple 220 that is in fluid communication with the axial bearing 166 via a conduit 222. The lubrication system 200 can further include a fourth grease nipple 224 that is disposed in the high pressure body portion 104. The fourth grease nipple 224 can be in fluid communication with the roof collar seal set 184 via a channel 226 and at least one hole 228 in the hose coupling 180. A fifth nipple 230 can be in fluid communication with lip seal 160 and the wear bushing 182 via a conduit 232.

The lubrication system 200 can further include a visible indicator 240 that extends from the body 100 when the lubricant pressure in fluid communication with the indicator exceeds a threshold. For example, the lubricant system can be in communication with visible indicator having a housing defining a hole and a cover, wherein the cover is spring-biased to block lubricant from exiting the hole until the pressure reaches a threshold. Upon the lubricant pressure exceeding the threshold, lubricant can flow through the hole to drive a pin to extend from the housing. Such indicators are also commonly referred to as reset indicators. In still further embodiments, the visible indicator 240 can comprise a pressure gauge that can optionally be configured to provide an electrical signal when the threshold pressure is reached. Optionally, the electrical signal provided by the pressure gauge can directly or indirectly (such as, through microcontroller or other processor control) effect movement, activation, and/or illumination of a visible component of the visible indicator 240.

The lubrication system 200 can further include pressure relief valves 260 that are configured to open to relieve pressure when lubricant pressures in fluid communication with a respective relief valve exceeds a threshold. The pressure relief valves 260 can include a hole that is closed by a spring-loaded steel ball 262. When the pressure exceeds the threshold, the lubricant pressure overcomes the spring force, and the ball moves to unblock the hole and allow lubricant to vent therefrom. The spring force and hole size can be selected to provide a desired threshold pressure at which the pressure relief valve 260 releases.

Figure 16:
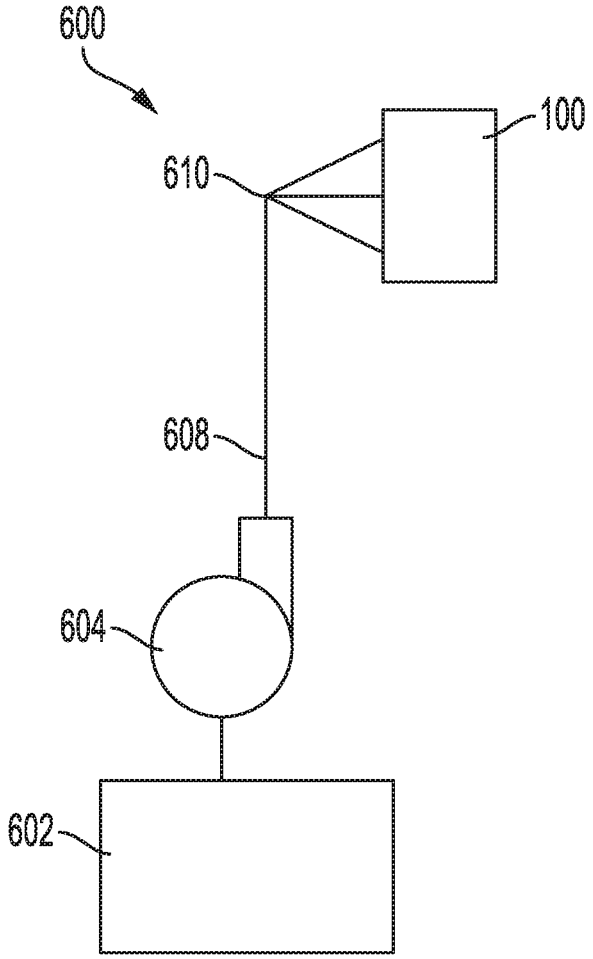
FIG. 16 is a schematic of a pump system for use with the high pressure injection flushing head as in FIG. 5.

Referring to FIG. 16, in some embodiments, a system 600 can include a central lubrication system that maintains the lubrication levels in the flushing head 100. The system can include a pressurized lubricant source such as, for example, a lubricant supply 602 and at least one pump 604. The at least one pump 604 can pump grease or other lubricant from the lubricant supply through one or more lines to deliver lubricant to one or more nipples of the lubrication system 200 (FIGS. 5, 10, 11, and 14). In some embodiments, the system 600 can comprise a single pump 604 that pumps lubricant through a conduit 608 to a diverter 610 that splits the lubricant into a plurality of pathways (e.g., five pathways) that respectively connect to a plurality of nipples (e.g., the five nipples (202, 212, 220, 224, 230)). In further optional embodiments, the pressurized lubricant source can comprise a pressurized lubricant cartridge that provides lubricant through the conduit 608 to the diverter 610 that redirects the lubricant to the nipples. The pressurized lubricant cartridge can optionally comprise a small battery-powered pump and a lubricant supply. In some optional aspects, the pressurized lubricant cartridge can be manufactured by SKF. According to some optional aspects, the pressurized lubricant cartridge can be used in place of the lubricant supply 602 and pump 604.

The flushing head 100 can attach to a sled adapter bracket 620 that is configured to couple to the mast of the drilling rig. The flushing head 100 can attach to the sled adapter bracket 620, for example, via screws or other suitable fasteners. According to another aspect, the flushing head 100 can include threaded holes in various places around its circumference in order to allow a plurality attachment locations (e.g., first location 622, second location 624, and third location 626) for the sled adapter bracket. In this way, the flushing head 100 can be oriented in order to optimize accessibility of the nipples, the low pressure hose coupling, and other features of the flushing head. Optionally, the holes that receive the fasteners in the sled adapter bracket can comprise elongate slots. In this way, the slots can enable the position of the sled adapter bracket 620 to be adjustable with respect to the flushing head 100 to account for misalignment.

According to other aspects, the flushing head 100 can be selectively fitted with a plurality of adapters so that various drill rod sizes and rod profile types can operatively couple to the flushing head. The main drive shaft 106 can include a flange 250 that provides an attachment location for a rod adapter 400. The rod adapter 400 can include a complementary flange 402 with corresponding holes to receive bolts 252 for attachment to the flushing head 100. Accordingly, the chuck drives, via a drill rod coupled with the rod adapter, the main drive shaft. The rod adapter can have an outer portion 410 and an inner portion 420. The inner portion can have a flange 422 that rests against a ledge 412 of outer portion 410. The flange 422 can have, in cross section in a plane transverse to the adapter's longitudinal dimension, a star profile (e.g. having triangular protrusions) so that holes are defined between the flange 422 and the ledge 412 to allow air or water to pass therethrough. Main drive shaft 106 and inner drive shaft 108 can have respective recessed annuluses 174, 176 that receive respective outer and inner protruding hollow cylindrical portions 430, 432 of the rod adapter 400. Both ends of each of the outer portion and the inner portion can comprise annular grooves 440 to receive O-rings 442 or other types of seals. When the flange 402 of the flushing head 100 is bolted to the flange 250 of the rod adapter 400, protruding hollow cylindrical portion 430 can be received within an inner circumferential wall of the main drive shaft 106, and protruding hollow cylindrical portion 432 can be received within an inner circumferential wall of the inner drive shaft 108. The seals 440 can engage respective surfaces of the drive shaft 102 to fluidly seal the drive shaft to the rod adapter 400. Accordingly, the rod adapter 400 can effectively seal its respective high and low pressure channels at a first end that attaches to the flushing head 100 and at a second end that attaches to a drilling rod.

Figure 12:
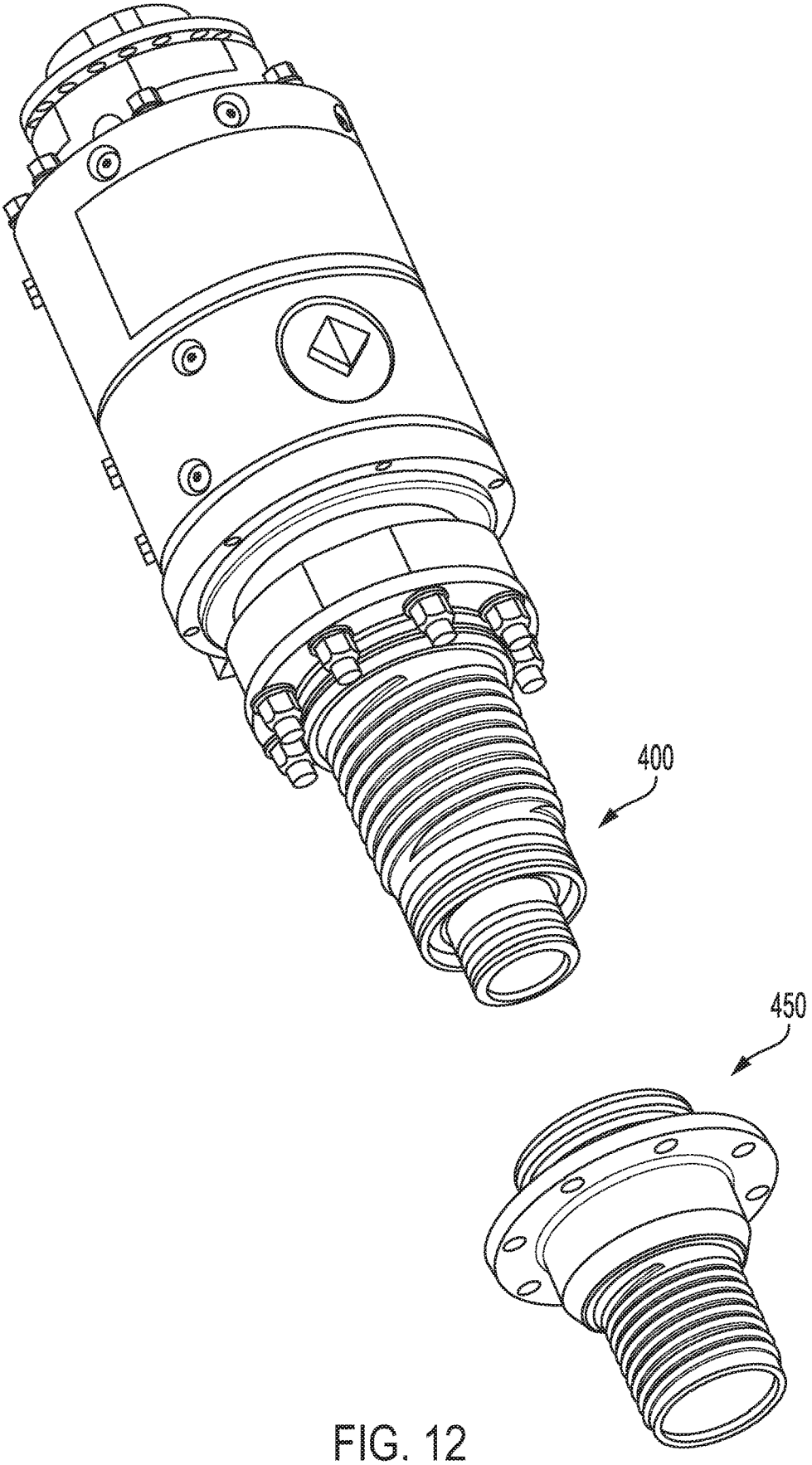
FIG. 12 is a perspective view of the high pressure injection flushing head as in FIG. 5 with the first rod adapter as in FIG. 8A and the second rod adapter as in FIG. 9.
Figure 13:
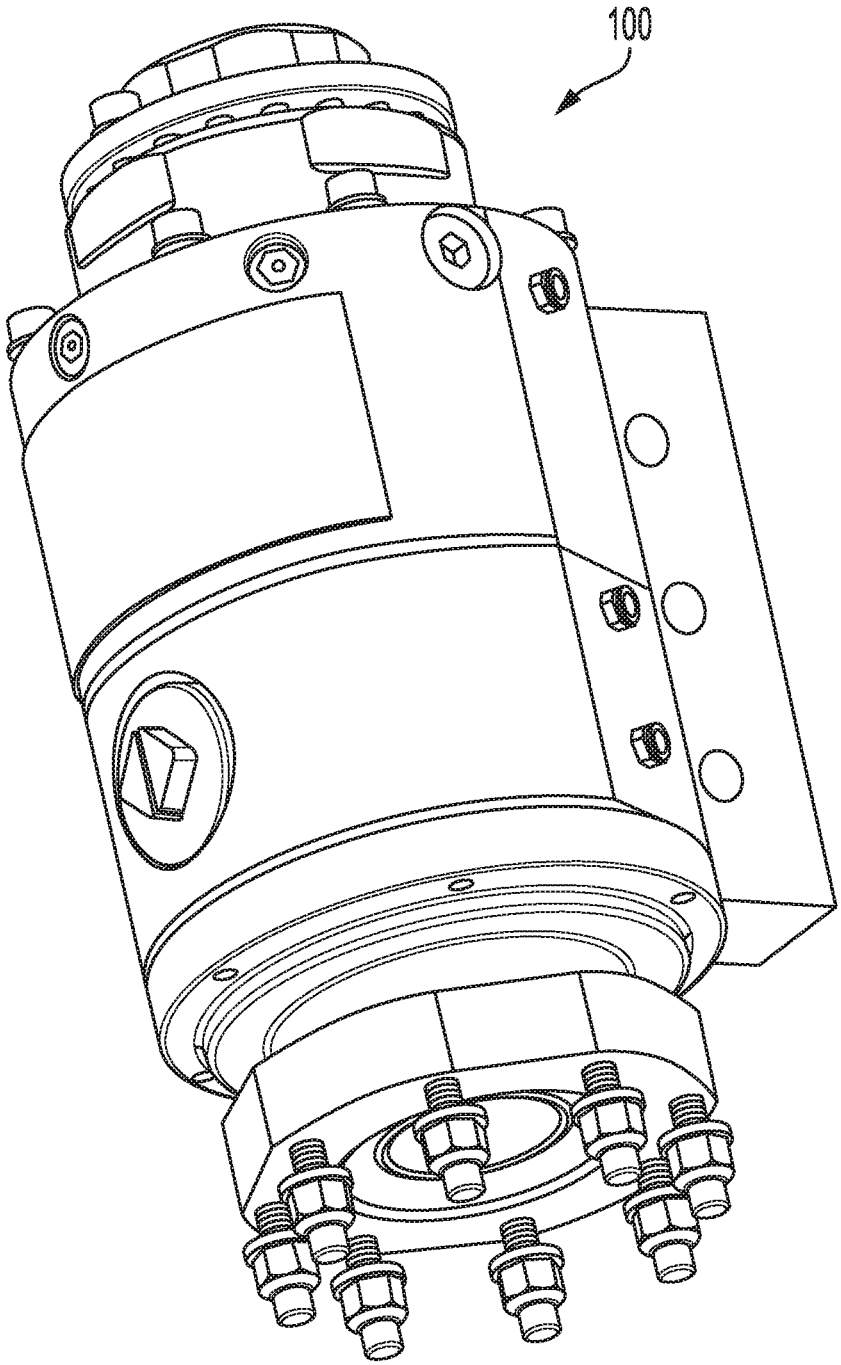
FIG. 13 is another perspective view of the high pressure injection flushing head as in FIG. 5.
Figure 14:
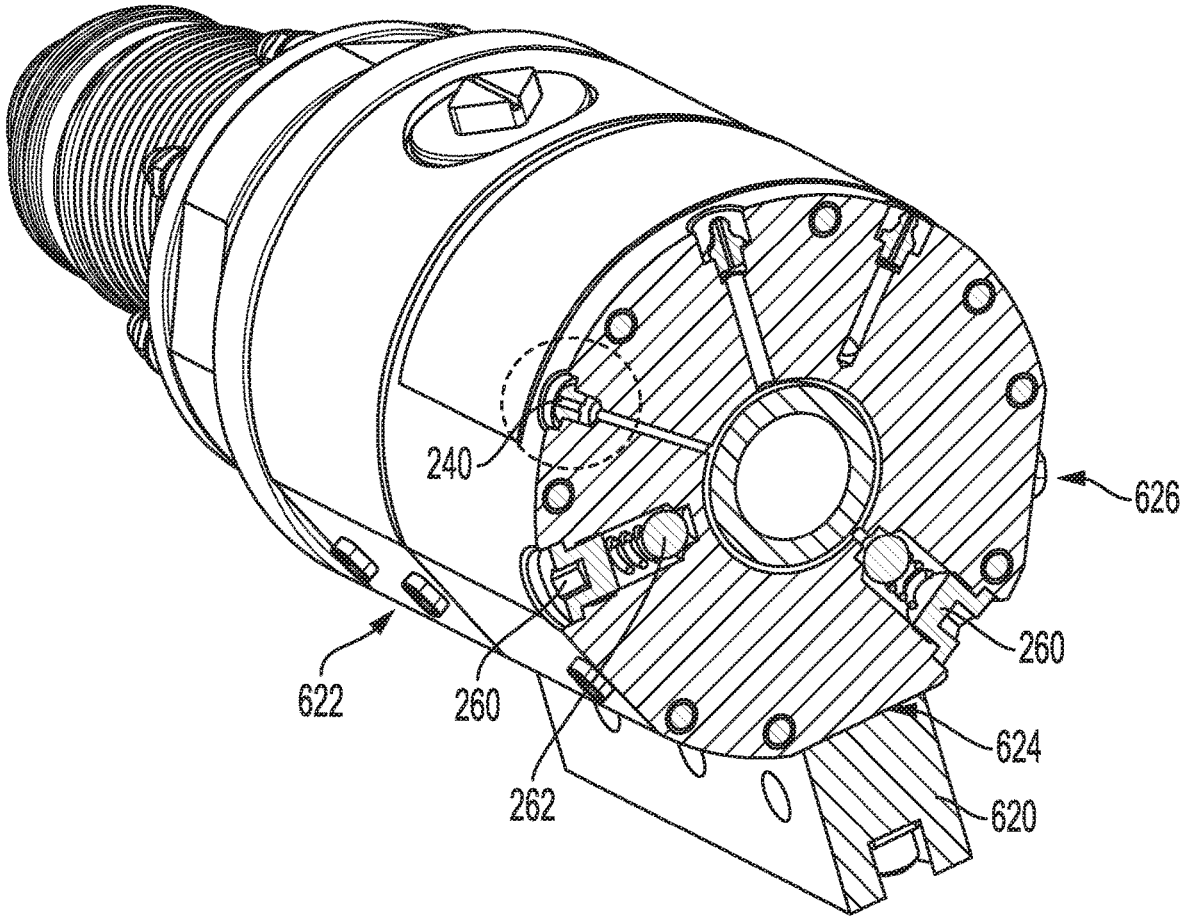
FIG. 14 is a cutaway view of the high pressure injection flushing head as in FIG. 5.
Figure 15:
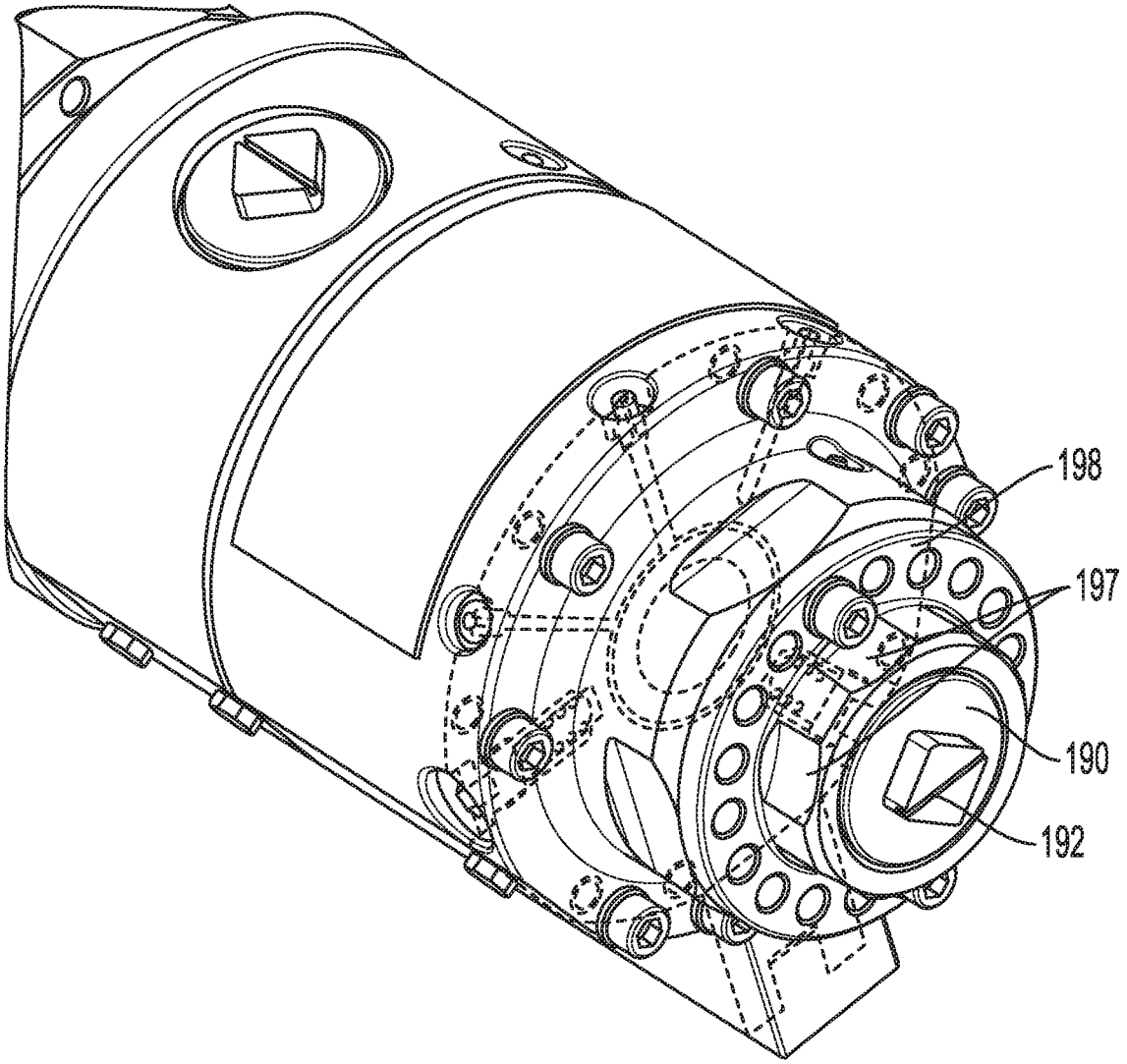
FIG. 15 is a partial perspective view of the high pressure injection flushing head as in FIG. 5 with a counter secure nut coupled thereto.

Referring to FIG. 12, in operation, a first rod adapter 400 can be coupled to a first drill rod. For example, a first end of the first rod adapter 400 can be attached to the flushing head 100, and an opposing second end of the first rod adapter can be attached to the first drill rod. After use of the first drill rod, the first drill rod can be decoupled from the first rod adapter, and the first rod adapter can be decoupled from the flushing head 100. Then, the first rod adapter can be replaced with a second rod adapter 450 that is different from the first rod adapter in at least one of size (e.g., diameter), profile (e.g., cross-sectional profile), or thread type (e.g., thread pitch, single vs. dual thread, thread height, thread taper, etc.). After the second rod adapter has replaced the first rod adapter, a second drill rod can be engaged with the second rod adapter, with the second drill rod being different from the first drill rod in at least one of size (e.g., diameter), profile (e.g., cross-sectional profile), or thread type. For example, a first end of the second rod adapter 450 can be attached to the flushing head 100, and an opposing second end of the second rod adapter can be attached to the second drill rod. In this way, the flushing head can be adapted for use with a plurality of rod types. A single flushing head can, therefore, be used with a plurality of rod types.

It is contemplated that different rods (e.g., of varying sizes and types) can be used to form different sizes and types of concrete columns, and the different rods can be selected based on the application and desired result. It is further contemplated that a single rod size and type can be used for an entire column.

Exemplary Aspects

In view of the described devices, systems, and methods and variations thereof, herein below are described certain more particularly described aspects of the invention. These particularly recited aspects should not however be interpreted to have any limiting effect on any different claims containing different or more general teachings described herein, or that the "particular" aspects are somehow limited in some way other than the inherent meanings of the language literally used therein.

Aspect 1: A high pressure injection flushing head comprising: a flushing body comprising: an upper body portion, and a lower body portion coupled to the upper body portion, wherein the upper body portion and the lower body portion cooperate to define a bore; a shaft rotatably disposed at least partially within the bore; and a plurality of rotary elements that are configured to facilitate rotational movement of the shaft relative to the flushing body, wherein the flushing body comprises a lubrication system having: at least one lubricant nipple, and a network of pathways in fluid communication with the at least one lubricant nipple that are configured to deliver grease to the rotary elements.

Aspect 2: The high pressure injection flushing head of aspect 1, wherein the shaft defines a flange that is configured to couple to a corresponding flange of a rod adapter.

Aspect 3: The high pressure injection flushing head of aspect 1 or aspect 2, wherein each lubricant nipple of the at least one lubricant nipple is in fluid communication, via the network of pathways, with a maximum of two rotary elements of the plurality of rotary elements.

Aspect 4: The high pressure injection flushing head of any one of the preceding aspects, wherein the lubrication system further comprises at least one grease pressure indicator in fluid communication with the at least one lubricant nipple.

Aspect 5: The high pressure injection flushing head of any one of the preceding aspects, wherein the upper body portion and the lower body portion of the flushing body are coupled together by at least one screw.

Aspect 6: The high pressure injection flushing head of any one of the preceding aspects, further comprising a wear bushing rotatably disposed within the bore.

Aspect 7: The high pressure injection flushing head of aspect 6, wherein the wear bushing comprises at least one of a tungsten carbide nickel coating, a chromized coating, or a QPQ prepared surface.

Aspect 8: The high pressure injection flushing head of aspect 6 or aspect 7, further comprising a high pressure hose coupling.

Aspect 9: The high pressure injection flushing head of aspect 8, wherein the high pressure hose coupling is threadedly coupled to the flushing body so that rotation of the high pressure hose coupling with respect to the flushing body is configured to move the high pressure hose coupling axially with respect to the wear bushing to define a select axial spacing between the high pressure hose coupling and the wear bushing.

Aspect 10: The high pressure injection flushing head of aspect 9, wherein the select axial spacing between the high pressure hose coupling and the wear bushing is less than 3 millimeters.

Aspect 11: The high pressure injection flushing head of aspect 10, wherein the select axial spacing between the high pressure hose coupling and the wear bushing is less than 1 millimeter.

Aspect 12: The high pressure injection flushing head of aspect 11, wherein the select axial spacing between the high pressure hose coupling and the wear bushing is less than 0.1 millimeter.

Aspect 13: The high pressure injection flushing head of any one of aspects 8-12, further comprising an axially compressible seal disposed between the wear bushing and the high pressure hose coupling.

Aspect 14: The high pressure injection flushing head of any one of aspects 8-13, wherein the high pressure hose coupling has a diameter of 2 inches or more.

Aspect 15: The high pressure injection flushing head of any one of aspects 8-13, wherein the high pressure hose coupling has a diameter of 1.5 inches or less.

Aspect 16: The high pressure injection flushing head of any one of the preceding aspects, wherein the plurality of rotary elements comprises: a thrust bearing in engagement between the upper body portion of the flushing body and the shaft; a radial bearing in engagement between the lower body portion of the flushing body and the shaft; and tapered roller bearing in engagement between the flushing body and the shaft, wherein the tapered roller bearing is disposed between the radial bearing and the thrust bearing with respect to a rotational axis of the high pressure injection flushing head.

Aspect 17: The high pressure injection flushing head of any one of the preceding aspects, wherein the shaft defines an inner bore having an inner diameter, wherein the diameter of the inner bore of the shaft is between 34.5 and 45 millimeters.

Aspect 18: An apparatus comprising: the high pressure injection flushing head of any one of aspects 1-17; and a rod adapter having a first end that is attached to the flushing head and a second end that is configured to attach to a drill rod.

Aspect 19: An apparatus comprising: the high pressure injection flushing head of any one of aspects 1-17; a pressurized lubrication source that is configured to provide a lubricant to the high pressure injection flushing head; and a lubricant diverter that is configured to receive the lubricant from the pressurized lubricant source, wherein the lubricant diverter defines at least a portion of a conduit between the grease pump and the at least one lubricant nipple.

Aspect 20: The apparatus of aspect 19, wherein the pressurized lubrication source comprises a grease supply and a grease pump that is configured to pump grease from the grease supply to the high pressure injection flushing head.

Aspect 21: The apparatus of aspect 19, wherein the pressurized lubrication source comprises a pressurized lubricant cartridge.

Aspect 22: A method of using the apparatus of aspect 18, wherein the rod adapter of the apparatus is a first rod adapter that is coupled to a first drill rod, the method comprising: decoupling the first drill rod from the first rod adapter of the apparatus; and replacing the rod adapter with a second rod adapter different than the rod adapter in at least one of size or profile, wherein replacing the rod adapter with a second rod adapter comprises attaching a first end of the second rod adapter to the flushing head; and engaging a second drill rod with a second end of the second rod adapter, wherein the second drill rod is different from the first drill rod in at least one of size, profile, or thread type.

Aspect 23: A high pressure injection flushing head comprising: a flushing body comprising: an upper body portion, and a lower body portion coupled to the upper body portion, wherein the upper body portion and the lower body portion cooperate to define a bore; a shaft rotatably disposed at least partially within the bore; and a plurality of rotary elements that are configured to facilitate rotational movement of the shaft relative to the flushing body, wherein the plurality of rotary elements comprises: a thrust bearing in engagement between the upper body portion of the flushing body and the shaft; a radial bearing in engagement between the lower body portion of the flushing body and the shaft; and tapered roller bearing in engagement between the flushing body and the shaft, wherein the tapered roller bearing is disposed between the radial bearing and the thrust bearing with respect to a rotational axis of the high pressure injection flushing head.

Aspect 24: A high pressure injection flushing head comprising: a flushing body comprising: an upper body portion, and a lower body portion coupled to the upper body portion, wherein the upper body portion and the lower body portion cooperate to define a bore; a shaft rotatably disposed at least partially within the bore; a plurality of rotary elements that are configured to facilitate rotational movement of the shaft relative to the flushing body; a wear bushing rotatably disposed within the bore; and a high pressure hose coupling, wherein the high pressure hose coupling is threadedly coupled to the flushing body so that rotation of the high pressure hose coupling with respect to the flushing body is configured to move the high pressure hose coupling axially with respect to the wear bushing to define a select axial spacing between the high pressure hose coupling and the wear bushing.

Those skilled in the art will recognize, or be able to ascertain using no more than routine experimentation, many equivalents to the specific embodiments of the method and compositions described herein. Such equivalents are intended to be encompassed by the following claims.

What is claimed is:

1. A high pressure injection flushing head comprising:
- a flushing body comprising:
  - an upper body portion, and
  - a lower body portion coupled to the upper body portion, wherein the upper body portion and the lower body portion cooperate to define a bore, wherein the lower body portion comprises a fluid connection;
- a shaft rotatably disposed at least partially within the bore; and
- a plurality of rotary elements that are configured to facilitate rotational movement of the shaft relative to the flushing body, wherein the plurality of rotary elements comprises:
  - a thrust bearing in engagement between the upper body portion of the flushing body and the shaft;
  - a radial bearing in engagement between the lower body portion of the flushing body and the shaft; and
  - a tapered roller bearing in engagement between the flushing body and the shaft, wherein the tapered roller bearing is disposed between the radial bearing and the thrust bearing with respect to a rotational axis of the high pressure injection flushing head, wherein the flushing body comprises a lubrication system having:
  - at least one lubricant nipple,
  - a network of pathways in fluid communication with the at least one lubricant nipple that are configured to deliver grease to the rotary elements; and
  - at least one grease pressure indicator in fluid communication with the at least one lubricant nipple.

2. The high pressure injection flushing head of claim 1, wherein the shaft defines a flange that is configured to couple to a corresponding flange of a rod adapter.

3. The high pressure injection flushing head of claim 1, wherein each lubricant nipple of the at least one lubricant nipple is in fluid communication, via the network of pathways, with a maximum of two rotary elements of the plurality of rotary elements.

4. The high pressure injection flushing head of claim 1, wherein the upper body portion and the lower body portion of the flushing body are coupled together by at least one screw.

5. The high pressure injection flushing head of claim 1, wherein the shaft defines an inner bore having an inner diameter, wherein the diameter of the inner bore of the shaft is between 34.5 and 45 millimeters.

6. An apparatus comprising:
- the high pressure injection flushing head of claim 1; and
- a rod adapter having a first end that is attached to the flushing head and a second end that is configured to attach to a drill rod.

7. A high pressure injection flushing head comprising:
- a flushing body comprising:
  - an upper body portion, and
  - a lower body portion coupled to the upper body portion, wherein the upper body portion and the lower body portion cooperate to define a bore, wherein the lower body portion comprises a fluid connection;
- a shaft rotatably disposed at least partially within the bore;
- a wear bushing rotatably disposed within the bore;
- a plurality of rotary elements that are configured to facilitate rotational movement of the shaft relative to the flushing body, wherein the plurality of rotary elements comprises:
  - a thrust bearing in engagement between the upper body portion of the flushing body and the shaft;

a radial bearing in engagement between the lower body portion of the flushing body and the shaft; and a tapered roller bearing in engagement between the flushing body and the shaft, wherein the tapered roller bearing is disposed between the radial bearing and the thrust bearing with respect to a rotational axis of the high pressure injection flushing head, wherein the flushing body comprises a lubrication system having:

at least one lubricant nipple, and a network of pathways in fluid communication with the at least one lubricant nipple that are configured to deliver grease to the rotary elements.

8. The high pressure injection flushing head of claim 7, wherein the wear bushing comprises at least one of a tungsten carbide nickel coating, a chromized coating, or a quench-polish-quench (QPQ) prepared surface.

9. A high pressure injection flushing head comprising:

a flushing body comprising:

an upper body portion, and a lower body portion coupled to the upper body portion, wherein the upper body portion and the lower body portion cooperate to define a bore, wherein the lower body portion comprises a fluid connection;

a high pressure hose coupling;

a shaft rotatably disposed at least partially within the bore;

a plurality of rotary elements that are configured to facilitate rotational movement of the shaft relative to the flushing body, wherein the plurality of rotary elements comprises:

a thrust bearing in engagement between the upper body portion of the flushing body and the shaft;

a radial bearing in engagement between the lower body portion of the flushing body and the shaft; and a tapered roller bearing in engagement between the flushing body and the shaft, wherein the tapered roller bearing is disposed between the radial bearing and the thrust bearing with respect to a rotational axis of the high pressure injection flushing head, wherein the flushing body comprises a lubrication system having:

at least one lubricant nipple, and a network of pathways in fluid communication with the at least one lubricant nipple that are configured to deliver grease to the rotary elements.

10. The high pressure injection flushing head of claim 9, further comprising a wear bushing rotatably disposed within the bore, wherein the high pressure hose coupling is threadedly coupled to the flushing body so that rotation of the high pressure hose coupling with respect to the flushing body is configured to move the high pressure hose coupling axially with respect to the wear bushing to define a select axial spacing between the high pressure hose coupling and the wear bushing.

11. The high pressure injection flushing head of claim 10, wherein the select axial spacing between the high pressure hose coupling and the wear bushing is less than 3 millimeters.

12. The high pressure injection flushing head of claim 11, wherein the select axial spacing between the high pressure hose coupling and the wear bushing is less than 1 millimeter.

13. The high pressure injection flushing head of claim 12, wherein the select axial spacing between the high pressure hose coupling and the wear bushing is less than 0.1 millimeter.

14. The high pressure injection flushing head of claim 9, further comprising an axially compressible seal disposed between the wear bushing and the high pressure hose coupling.

15. The high pressure injection flushing head of claim 9, wherein the high pressure hose coupling has a diameter of 2 inches or more.

16. The high pressure injection flushing head of claim 9, wherein the high pressure hose coupling has a diameter of 1.5 inches or less.

17. An apparatus comprising:

a high pressure injection flushing head comprising:

a flushing body comprising:

an upper body portion, and a lower body portion coupled to the upper body portion, wherein the upper body portion and the lower body portion cooperate to define a bore, wherein the lower body portion comprises a fluid connection;

a shaft rotatably disposed at least partially within the bore; and a plurality of rotary elements that are configured to facilitate rotational movement of the shaft relative to the flushing body, wherein the plurality of rotary elements comprises:

a thrust bearing in engagement between the upper body portion of the flushing body and the shaft;

a radial bearing in engagement between the lower body portion of the flushing body and the shaft; and a tapered roller bearing in engagement between the flushing body and the shaft, wherein the tapered roller bearing is disposed between the radial bearing and the thrust bearing with respect to a rotational axis of the high pressure injection flushing head, wherein the flushing body comprises a lubrication system having:

at least one lubricant nipple, and a network of pathways in fluid communication with the at least one lubricant nipple that are configured to deliver grease to the rotary elements;

a pressurized lubrication source that is configured to provide a lubricant to the high pressure injection flushing head; and a lubricant diverter that is configured to receive the lubricant from the pressurized lubricant source, wherein the lubricant diverter defines at least a portion of a conduit between the pressurized lubricant source and the at least one lubricant nipple.

18. The apparatus of claim 17, wherein the pressurized lubrication source comprises a grease supply and a grease pump that is configured to pump grease from the grease supply to the high pressure injection flushing head.

19. The apparatus of claim 17, wherein the pressurized lubrication source comprises a pressurized lubricant cartridge.

20. A method comprising:

using an apparatus comprising:

a high pressure injection flushing head comprising:

a flushing body comprising:

an upper body portion, and a lower body portion coupled to the upper body portion, wherein the upper body portion and the lower body portion cooperate to define a bore, wherein the lower body portion comprises a fluid connection;

a shaft rotatably disposed at least partially within the bore; and a plurality of rotary elements that are configured to facilitate rotational movement of the shaft relative to the flushing body, wherein the plurality of rotary elements comprises:

a thrust bearing in engagement between the upper body portion of the flushing body and the shaft;

a radial bearing in engagement between the lower body portion of the flushing body and the shaft; and a tapered roller bearing in engagement between the flushing body and the shaft, wherein the tapered roller bearing is disposed between the radial bearing and the thrust bearing with respect to a rotational axis of the high pressure injection flushing head, wherein the flushing body comprises a lubrication system having;

at least one lubricant nipple, and a network of pathways in fluid communication with the at least one lubricant nipple that are configured to deliver grease to the rotary elements; and a rod adapter having a first end that is attached to the flushing head and a second end that is configured to attach to a drill rod, wherein the rod adapter of the apparatus is a first rod adapter that is coupled to a first drill rod;

decoupling the first drill rod from the first rod adapter of the apparatus;

replacing the rod adapter with a second rod adapter different than the rod adapter in at least one of size or profile, wherein replacing the rod adapter with a second rod adapter comprises attaching a first end of the second rod adapter to the flushing head; and engaging a second drill rod with a second end of the second rod adapter, wherein the second drill rod is different from the first drill rod in at least one of size, profile, or thread type.

21. A high pressure injection flushing head comprising:

a flushing body comprising:

an upper body portion, and a lower body portion coupled to the upper body portion, wherein the upper body portion and the lower body portion cooperate to define a bore, wherein the lower body portion comprises a fluid connection;

a shaft rotatably disposed at least partially within the bore;

a wear bushing rotatably disposed within the bore, wherein the wear bushing comprises at least one of a tungsten carbide nickel coating, a chromized coating, or a quench-polish-quench (QPQ) prepared surface; and a plurality of rotary elements that are configured to facilitate rotational movement of the shaft relative to the flushing body, wherein the flushing body comprises a lubrication system having:

at least one lubricant nipple, and a network of pathways in fluid communication with the at least one lubricant nipple that are configured to deliver grease to the rotary elements.

22. The high pressure injection flushing head of claim 21, wherein the plurality of rotary elements comprises:

a thrust bearing in engagement between the upper body portion of the flushing body and the shaft;

a radial bearing in engagement between the lower body portion of the flushing body and the shaft; and a tapered roller bearing in engagement between the flushing body and the shaft, wherein the tapered roller bearing is disposed between the radial bearing and the thrust bearing with respect to a rotational axis of the high pressure injection flushing head.

* * * * *